US006928948B1

(12) United States Patent
Shannon

(10) Patent No.: US 6,928,948 B1
(45) Date of Patent: Aug. 16, 2005

(54) TRANSDUCER MOUNTING BLOCK

(75) Inventor: Allen T. Shannon, 1367 Crawford Rd., Waynesville, NC (US) 28785

(73) Assignee: Allen T. Shannon, Waynesville, NC (US)

( * ) Notice: Subject to any disclaimer, the term of this patent is extended or adjusted under 35 U.S.C. 154(b) by 69 days.

(21) Appl. No.: 10/372,439

(22) Filed: Feb. 21, 2003

Related U.S. Application Data

(60) Provisional application No. 60/373,385, filed on Apr. 18, 2002.

(51) Int. Cl.[7] ..... B63B 17/00

(52) U.S. Cl. ..... 114/343; 367/173; 73/866.5

(58) Field of Search ..... 114/343, 364; 367/173; 248/205.3; 73/866.5

(56) References Cited

U.S. PATENT DOCUMENTS 3,476,257 A * 11/1969 O'Connell ..... 211/13.1
3,989,213 A 11/1976 Allen
4,255,216 A * 3/1981 Conant et al. ..... 156/80
4,456,210 A 6/1984 McBride
4,811,310 A 3/1989 Wille
4,962,907 A * 10/1990 Gary ..... 248/205.3
4,984,462 A * 1/1991 Hass et al. ..... 73/293
5,016,225 A 5/1991 Blomberg
5,028,026 A 7/1991 Phillips et al.
5,142,497 A * 8/1992 Warrow ..... 367/12
5,173,881 A * 12/1992 Sindle ..... 367/101
5,303,204 A * 4/1994 Wertsberger ..... 367/99
5,529,272 A 6/1996 Baublitz, Sr.
5,573,211 A 11/1996 Reeves
5,583,289 A * 12/1996 Wiggerman et al. ..... 73/182
5,611,510 A * 3/1997 Yamamoto ..... 248/205.3
5,644,093 A * 7/1997 Wright et al. ..... 73/866.5
6,019,333 A 2/2000 Waller
6,291,768 B1 * 9/2001 Reiker ..... 174/62
6,484,656 B2 * 11/2002 Mears et al. ..... 114/68
6,490,229 B1 12/2002 Caver
6,595,144 B1 * 7/2003 Doyle ..... 108/147

OTHER PUBLICATIONS

Cabela's Catalog, p. 20, 135, showing two transducer mounts (DC–01–0102, CC–01–2684). The catalog pages are undated but were in existence prior to Dec. 2002.

* cited by examiner

*Primary Examiner*—Andrew D. Wright

(57) ABSTRACT

A mounting system for attaching a transducer to a surface such as the transom of a boat hull is disclosed. The system consists of a mounting block, fasteners, and an item that the installer wishes to attach (such as a transducer or plate). The block is formed of corrosion-resistant material. The block has an adhesive layer that bonds the block to the surface; no fasteners are required to mount the block to the surface. The block has at least one T-shaped slot that retains corrosion-resistant fasteners, which anchor the transducer to the block when the fasteners are tightened. The adhesive layer is protected by a removable layer that is peeled away just prior to pressing the block on the transom surface.

14 Claims, 3 Drawing Sheets

TRANSDUCER MOUNTING BLOCK

CROSS-REFERENCE TO RELATED APPLICATIONS

The benefit of the filing of U.S. provisional patent application Ser. No. 60/373,385, filed Apr. 18, 2002, which is incorporated herein by reference, is claimed.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Since the inception of seafaring, humans have endeavored to attach various items to the transoms of watercraft hulls to help determine conditions both above and below the water's surface. In the last half of the twentieth century, popularity of pleasure watercraft has risen sharply. Many users of such watercraft, just as mariners of old, need assistance with navigation, operation, and locating marine quarry such as fish and wrecks.

Paralleling the rise in numbers of pleasure watercraft, sensor (transducer) technology has also increased throughout the last few decades. Transducers have been produced that are far more compact, rugged, less costly, and precise then their predecessors. Such improvements have enabled the boat-building industry to employ various transducers to expand navigational and operational capabilities for new watercraft, thus creating a level of sophistication in watercraft that has never been seen before. The ever-present desire to navigate and operate watercraft more safely, along with the desire to find various types of marine quarry, has pushed users of pleasure watercraft to retrofit their existing craft with the newly available marine transducers. While the transom of a watercraft hull is often a convenient place to locate such sensors, few resources have been devoted to develop ways in which to attach marine transducers to transoms.

Marine environments are very harsh on watercraft and accessories. Transducers attached below the waterline must withstand water pressure and current when the craft is underway, as well as resist the effects of water chemistry, fouling from marine life, and impacts from obstacles in the water such as submerged logs and buoys. Transducers attached to the transom of a watercraft hull must also resist impacts from trailering, docking, and storage. Since watercraft, especially boats, are operated in all types of climates, a marine transducer and its attachment device must also withstand a variety of temperatures.

Several devices have been developed to mount a transducer to the transom of a boat hull—the most basic of these is a screwed-on bracket. In this device, a mounting bracket is screwed to the transom. This device requires a sealant between the transom and the bracket that is always susceptible to leakage, which can lead to hull and transom damage that is very costly to repair. It also requires the installer to drill holes, which adds complexity to the installation process. This device has various forms, from a stamped stainless steel clamp, to a polyethylene "mother" board, which attaches to the transom and has space where an installer can place several transducer brackets; while such improvements may reduce the overall number of holes one must drill in the transom, this family of devices still requires at least one hole in the transom to mount the "mother" board.

Another mounting device uses a stainless-steel clamp that wraps around the submerged portion of a trolling motor. U.S. Pat. No. 6,490,229, issued to Caver describes such a device. This arrangement limits the operation of the transducer to the low speeds where the trolling motor is operating, and it creates the potential for interference between the motor and the transducer.

Yet another mounting device hangs over the transom and hooks to the lip of the gunwale. U.S. Pat. No. 5,529,272 issued to Baublitz, Sr. describes such a device. The arrangement is cumbersome and may interfere with other transom-mounted devices such as outboard engines, trolling motors, and trim tabs.

Another mounting device uses the drain hole that is generally located in the transom to mount the transducers. U.S. Pat. No. 4,811,310 issued to Willie describes such a device. The device uses a jamb nut with a washer and an o-ring as a seal. The disadvantage with this invention is that it prevents the owner from using the drain hole without removing the transducer. Furthermore, the number of transducers is proximately limited to the number of drain holes.

Since current transducer mounting systems have various features that make them marginally effective, the need exists for an improved mounting system to attach a marine transducer to the transom of a boat hull that results in minimal intrusion into the transom, is strong enough to withstand marine environments, and uses a minimum number of parts.

SUMMARY OF THE INVENTION

Briefly recited and according to its major aspects, the present invention is an attachment device that uses an adhesive backing to permanently bond the back of a mounting block to a selected surface such as the transom of a boat hull. The bond is strong enough to withstand marine environments and is convenient to activate. The mounting block is made from a corrosion-resistant, structural material. The block has a form that retains at least one transducer fastener in the direction normal to the face of the block while allowing freedom of motion in a direction parallel to the face of the block until the fastener is tightened. The block is dimensioned so that the fastener can be tightened with a single tool. There is no breach of the transom when the device is used because there is no drilling required for the device to function.

An important feature of the present invention is that it enables an installer to firmly and securely mount a marine transducer, or any other boltable item (e.g. a transducer plate, navigation light, or speed sensor), to a selected surface such as the transom of a boat hull with a minimum intrusion to the surface. Installation is simple with minimal time and tools.

Another feature of the present invention is that it is able to withstand marine environments by having a strong, water-resistant bond, and by being fabricated from corrosion-resistant materials.

Another feature of the present invention is that it has a minimum number of parts and material, thus anticipating low cost and high reliability.

Yet another feature of the present invention is that it allows a user to be able to remove the transducer periodically for maintenance, updates, or replacement.

These and other features and their advantages will be apparent to those skilled in the art of marine transducer design and installation from a careful reading of the Detailed Description of Preferred Embodiments accompanied by the following drawings.

DETAILED DESCRIPTION OF PREFERRED EMBODIMENTS

The preferred embodiment of the present invention is a device that relies primarily on a mounting block with an adhesive back to enable an installer to firmly attach a marine transducer to the transom of a boat hull without drilling holes in the transom or using complicated assemblies.

An alternative embodiment of the present invention is a system wherein a mounting block with an adhesive backing cooperates with appropriately sized corrosion-resistant transducer fasteners, a transducer plate, and perhaps a transducer assembly or other boltable item. The cooperation of these components as a system or apparatus will enable the boat owner to equip his or her boat with modem sensors or boltable items without having to drill holes in the transom.

Figure 1A:
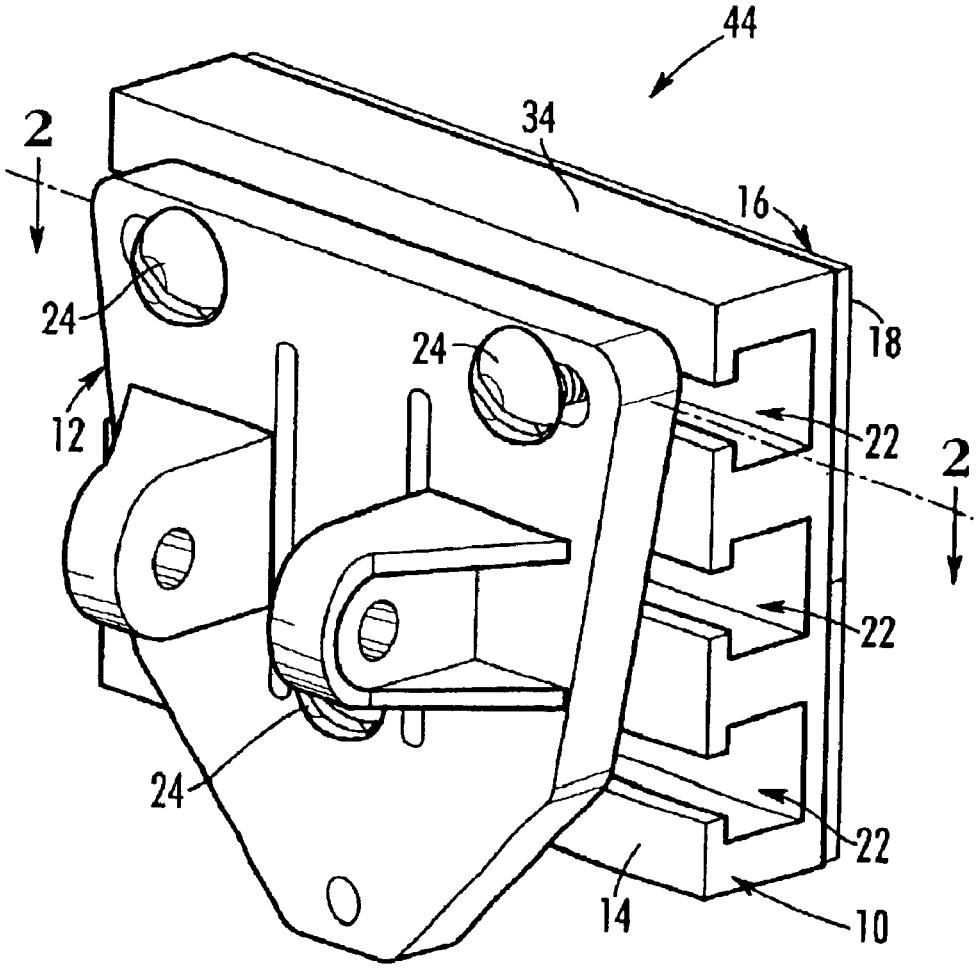
FIG. 1A is a perspective view of the device shown assembled with adjacent components as a system according to an embodiment of the present invention.
Figure 1B:
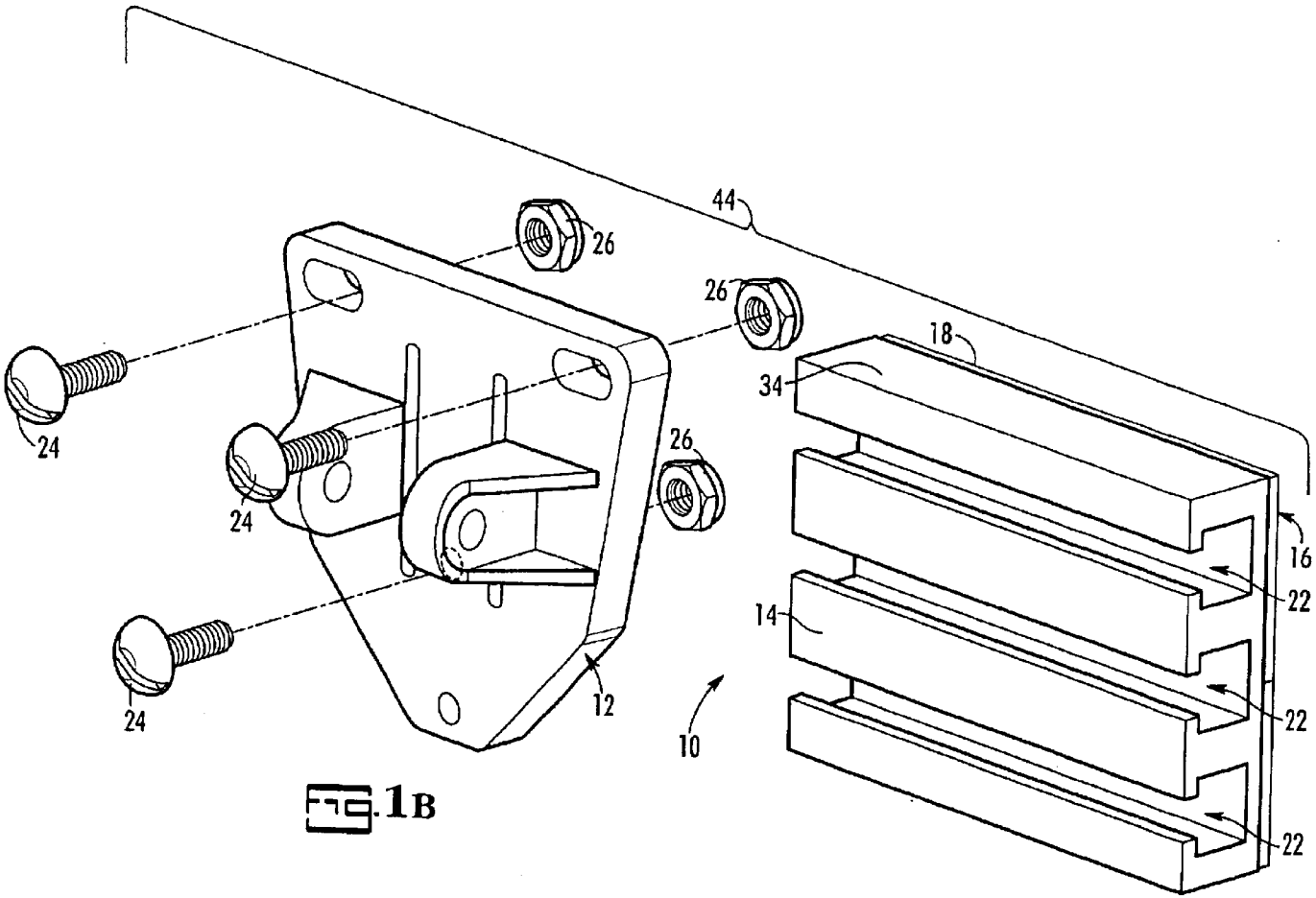
FIG. 1B is an exploded, perspective view of the system of FIG. 1A.

Referring now to the drawings, FIG. 1A and FIG. 1B show a mounting block 10 that is assembled to a transducer plate 12 forming a system 44 for affixing a transducer 40 to a surface 30. Transducer 40 is shown in phantom lines in FIG. 2 attached to transducer plate 12. Block 10 consists of a body 34, an adhesive layer 18, and a protective layer 20. Body 34 has a face 14 and a back 16. Transducer plate 12 interfaces with face 14, and back 16 interfaces with surface 30 as shown. In the preferred embodiment, surface 30 is the exterior of the transom of a boat hull.

Body 34 is preferably made of a corrosion-resistant material. In the preferred embodiment, body 34 is made of an anodized aluminum, such as type 6063, however other materials such as stainless steel, brass, plastic, wood, composite, or any other corrosion-resistant, structural material may be used. Body 34 is essentially rectangular with a height that is less than either the minor or major side dimensions. In any case, the outer form of body 34 should conform to appropriate manufacturing and marine design practice to reduce drag and material usage.

Figure 2:
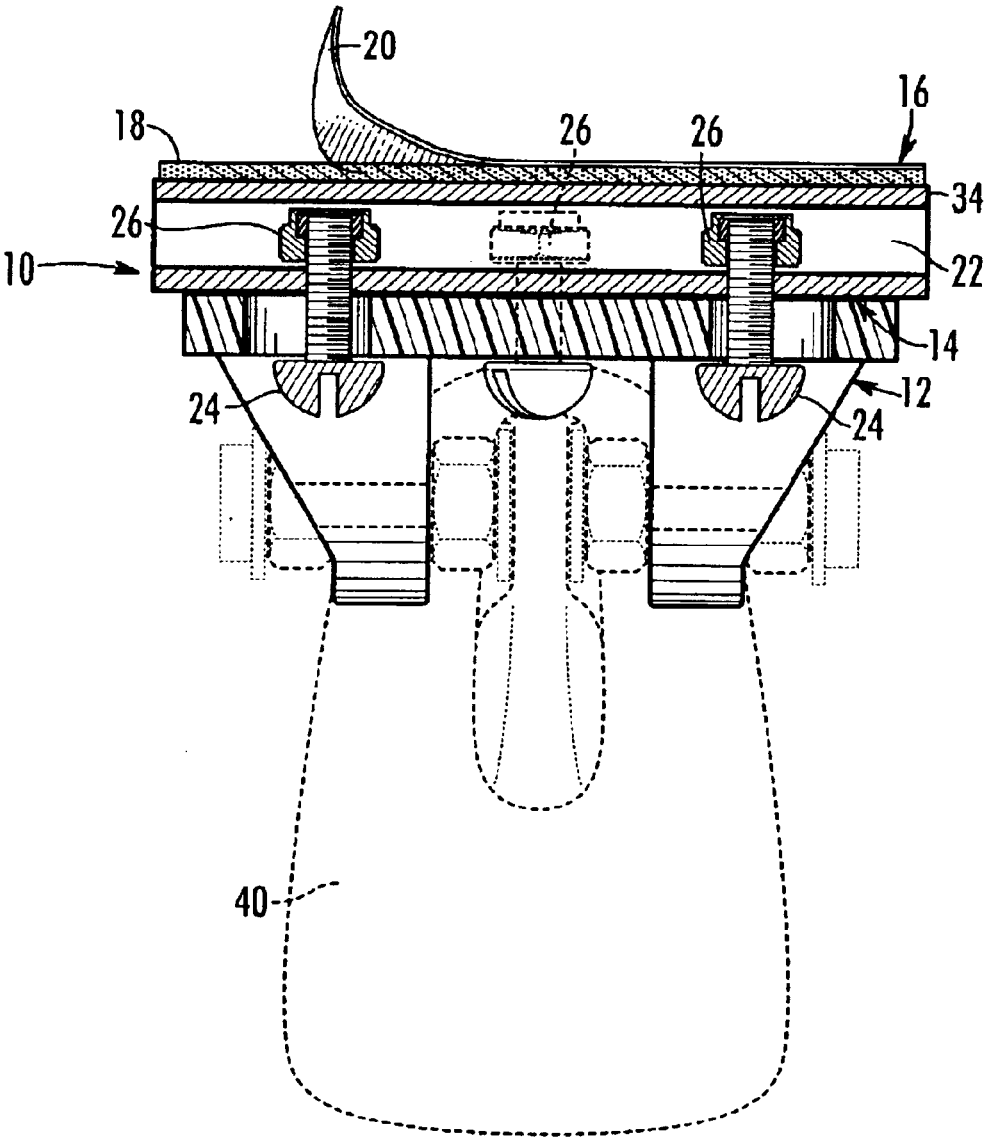
FIG. 2 is a top cross-sectional taken along lines 2—2 of FIG. 1A.

Referring now to FIG. 2, body 34 has features that provide an anchor point for corrosion-resistant transducer fasteners such as anchor screw 24 and anchor nut 26. At least one "T"-Shaped slot 22 is formed in face 14 of body 34 and provides such an anchor point. In the preferred embodiment, body 34 has 3 slots running across the full length of face 14 in order to receive three transducer fasteners. Slot 22 is dimensioned to allow anchor screw 24 to pass through normal to face 14 and to allow anchor nut 26 to be inserted into the minor side of body 34. However, slot 22 is dimensioned so that while anchor nut 26 may freely slide along in a direction parallel to face 14, anchor nut 26 may not turn while an installer is tightening anchor screw 24 into anchor nut 26. Slot 22 has enough depth to permit proper mating between anchor screw 24 and anchor nut 26, with anchor screw 24 just protruding from anchor nut 26. Slot 22 retains anchor screw 24 in a direction normal to face 14, thus allowing for controlled positional adjustment of the transducer just prior to the final tightening process; the transducer can be moved laterally across face 14 while anchor screw 24 is loose, but once anchor screw 24 is tight, the transducer can no longer move. Slot 22 allows for interchangeability or easy replacement of transducers, as well as for easy removal of transducers for protection during storage and docking.

Between surface 30 and back 16, and bonded to back 16, are adhesive layer 18 and protective layer 20. Adhesive layer 18 is strong enough to resist the effects of marine environments such as warm and cold water, vibration from operation and motion, as well as abrasion and shocks from docking and impacts. In the preferred embodiment, adhesive layer 18 is a pressure-sensitive, double-sided, high-bond strength acrylic adhesive tape such as VHB™ made by 3M Company. This tape bonds to a surface after pressure is applied to push the tape onto the surface. The bond is assisted when the user pushes the tape from one edge to the other in a rolling motion. Other embodiments using different types of strong, marine-resistant rubber or plastic-based adhesives are possible including adhesives that are heat-sensitive and solvent-sensitive.

Adhesive layer 18 is protected during storage and preparation by protective layer 20. Protective layer 20 is made of plastic or paper that keeps adhesive layer 18 ready to bond, but is easily removable by peeling. Protective layer 20 allows an installer to position block 10 and then, after removing protective layer 20, an installer can permanently attach block 10 to a surface. There is no mess and practically no tools are required.

The alternative embodiment of the present invention is shown on FIG. 2 where block 10 is incorporated into system 44 including sensor plate 12, anchor screws 24, anchor nuts 26, and, perhaps, an appropriate transducer 40. A cleaning pad to prepare surface 30 for bonding to adhesive layer 18 may also be offered.

It will be readily apparent to those skilled in the art of marine transducer design and installation that many changes and substitutions can be made to the foregoing preferred embodiments without departing from the spirit and scope of the present invention, defines by the appended claims.

What is claimed is:

1. A block for adjustably mounting a transducer to the transom of a boat hull, said block comprising:

(a) a body with face and a back, said body having at least one longitudinally extending slot formed in said face;

(b) at least one fastener sized for mating with said longitudinally extending slot formed in said face, thus providing an adjustable attachment means for attaching a transducer to said face;

(c) an adhesive layer attached to said back of said body, wherein said adhesive layer will withstand a submerged marine environment and provide a permanent mount of said body to the transom of a boat hull without penetrating surface of said transom; and (d) a removable protective layer attached to said adhesive layer, so that when said protective layer is removed, said adhesive layer will be exposed thereby enabling said body to be permanently mounted to said transom of a boat hull.

2. The block as recited in claim 1, wherein said body is made from a corrosion-resistant material selected from the group consisting of aluminum, stainless steel, plastic composite, or wood.

3. The block as recited in claim 1, wherein said at least one longitudinally extending slot is formed in the shape of a T, thus enabling the retention of a nut in said at least one longitudinally extending slot.

4. The block as recited in claim 3, wherein said at least one longitudinally extending slot is dimensioned so that said retained nut will not rotate when a fastener is tightened into said nut.

5. The block as recited in claim 1, wherein said adhesive layer is made of a material selected from the group consisting of epoxy adhesives, acrylic adhesives and combinations thereof.

6. The block as recited in claim 1, wherein said adhesive layer is a pressure-sensitive adhesive tape.

7. A device for use with a boat, said boat having a transom said device comprising:

(a) a transducer adapted for sensing depth;

(b) a body with a face and a back, said body having at least one longitudinally extending slot formed in said face;

(c) at least one fastener sized for mating with said longitudinally extending slot formed in said face, thus providing an adjustable attachment means for attaching said transducer to said face;

(d) an adhesive layer attached to said back of said body, wherein said adhesive layer will withstand a submerged marine environment and provide a permanent mount of said body to the transom of a boat hull without penetrating surface of said transom; and (e) a removable protective layer attached to said adhesive layer, so that when said protective layer is removed, said adhesive layer will be exposed thereby enabling said body to be permanently mounted to said transom of a boat hull.

8. The device as recited in claim 7, wherein said adhesive layer is heat activated.

9. The device as recited in claim 7, wherein said adhesive layer is solvent activated.

10. The device as recited in claim 7, wherein said adhesive layer is a pressure sensitive tape.

11. The device as recited in claim 7, wherein said adhesive layer is made of a material selected from the group consisting of epoxy adhesives, acrylic adhesives, and combinations thereof.

12. An adjustable mounting system for use with a boat, said boat having a transom, said mounting system comprising:

(a) a boltable item;

(b) a body with a face and a back, said body having at least one longitudinally extending slot formed in said face;

(c) an adhesive layer attached to said back, wherein said adhesive layer will withstand a submerged marine environment and provide a permanent mount of said body to the transom of a boat hull without penetrating surface of said transom;

(d) at least one fastener sized for mating with said at least one longitudinally extending slot formed in said face, thus providing an attachment means for attaching said boltable item to said face and providing an adjustment means for adjusting said boltable item slidably across said face; and (e) a removable protective layer attached to said adhesive layer, so that when said protective layer is removed, said adhesive layer will be exposed thereby enabling said boltable item to be permanently mounted to said transom of a boat hull.

13. The mounting system as recited in claim 12, wherein said at least one fastener is corrosion-resistant.

14. The mounting system as recited in claim 12, wherein said boltable item is selected from the group consisting of a transducer plate, a transducer assembly, a sign plate, a navigation light, a speed sensor, or a depth sensor.

* * * * *